US009704356B2

(12) United States Patent
Rauworth

(10) Patent No.: US 9,704,356 B2
(45) Date of Patent: Jul. 11, 2017

(54) SYSTEM AND METHOD OF TIME-AUGMENTED ANNUNCIATION OF SIGNALS

(71) Applicant: Honeywell International Inc., Morristown, NJ (US)

(72) Inventor: Timothy A. Rauworth, West Chicago, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/257,371

(22) Filed: Apr. 21, 2014

(65) Prior Publication Data

US 2015/0302714 A1 Oct. 22, 2015

(51) Int. Cl.

| | |
|---|---|
| ***G08B 1/00*** | (2006.01) |
| ***G08B 3/10*** | (2006.01) |
| *G08B 17/00* | (2006.01) |

(52) U.S. Cl.

CPC ..... *G08B 3/10* (2013.01); *G08B 17/00* (2013.01)

(58) Field of Classification Search

CPC ..... G08B 25/008
USPC ..... 340/506, 507, 511, 526, 3.1
See application file for complete search history.

(56) References Cited

U.S. PATENT DOCUMENTS

| | | | | |
|---|---|---|---|---|
| 5,400,246 | A * | 3/1995 | Wilson et al. | 700/17 |
| 5,959,529 | A * | 9/1999 | Kail, IV | G01S 19/17 128/903 |
| 2009/0015418 | A1* | 1/2009 | Koike | G06F 21/554 340/636.1 |

* cited by examiner

*Primary Examiner* — Daryl Pope
(74) *Attorney, Agent, or Firm* — Husch Blackwell LLP

(57) ABSTRACT

An apparatus to set an output window includes an ambient condition detector from which non-alarm messages can be output at a pre-determined time. The ambient condition detector includes a real-time clock that can be set wirelessly by a real-time synchronizing message. A message emitting window can also be wirelessly pre-set. The non-alarm messages are emitted at respective times in the message emitting window.

19 Claims, 3 Drawing Sheets

Process for setting start/stop window

Process for setting detector clock

SYSTEM AND METHOD OF TIME-AUGMENTED ANNUNCIATION OF SIGNALS

FIELD

The application pertains to informational signals emitted by ambient condition detectors. More particularly, the application pertains to such detectors in which the time of emission of trouble or other signals can be adjusted by a user.

BACKGROUND

Many products, such as smoke detectors and carbon monoxide detectors, have trouble signals that are mandated by regulatory bodies. These signals, at times, annunciate in the middle of the night, causing end users distress and damaging the reputation of the products. It has been known to provide delayed trouble signals that were solely detector based and not integrated into a system with a time base.

Because of the importance of these signals in connection with normal detector operation, it would be desirable to provide these signals in a timely fashion without upsetting or distressing the customer/user population.

DETAILED DESCRIPTION

Figure 1:
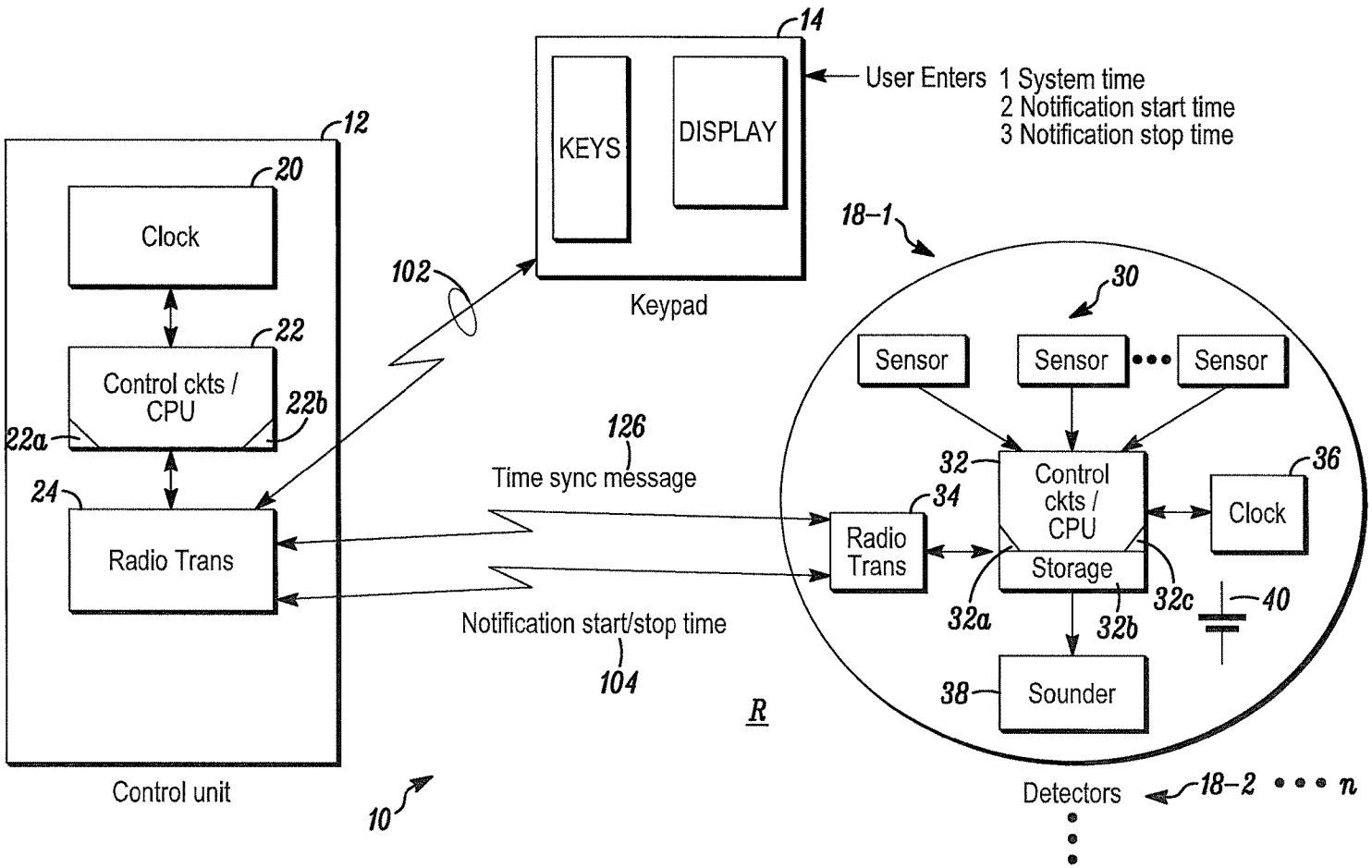
FIG. 1 is a system in accordance herewith.

While disclosed embodiments can take many different forms, specific embodiments hereof are shown in the drawings and will be described herein in detail with the understanding that the present disclosure is to be considered as an exemplification of the principles hereof as well as the best mode of practicing the same and is not intended to limit the claims hereof to the specific embodiment illustrated.

As discussed below, embodiments hereof prevent customers from being awakened by one or more trouble signals that might be emitted during hours of sleep. In embodiments hereof, a system connected detector receives current date and time information from a control unit as well as preference information about the time of day that annunciations should begin.

Types of trouble signals that cause audible annunciation are predictable. These include low battery warnings, detector dirty signals indicative of relatively high values of clear air output signals, and CO sensor end of life notices. These signals can safely be annunciated somewhat earlier than planned.

In disclosed embodiments, the respective sounders can be energized to emit a warning chirp earlier than required at a time when the end user will not be disturbed and will be more likely to service the unit. It will be understood that neither the types of detectors nor the non-alarm conditions being reported are limitations hereof.

FIG. 1 illustrates a system 10 in accordance herewith. The system 10 includes a control unit 12 that is in wired or wireless communication with a manually operable keypad 14. The control unit 12 is also in wireless communication with one or more ambient condition detectors, such as 18-1, 18-2 . . . **18-*n* that can be installed in a region R being monitored by the system 10**.

The control unit 12 can include a clock 20 and control circuits 22 that could be implemented in part by a programmable control unit **22*a* that executes a plurality of pre-stored instructions 22*b*. The unit 12 can also include a wireless radio transceiver 24 that can communicate wirelessly with the keypad 14 and the detectors 18-*i***.

Those of skill will understand that a variety of detectors come within the scope of the plurality 18. A representative detector 18-1 will be described, and that description will be applicable to other detectors 18-2 . . . **18-*n*** of the plurality.

The detector 18-1 can include one or more ambient condition sensors illustrated by the plurality 30. The sensors can, without limitation, include smoke sensors, flame sensors, gas sensors, and the like. The detector 18-1 can also include control circuits, such as 32 that can include a programmable processor **32*a*, a storage unit 32*b*, and executable instructions 32*c*. The control circuits 32 can be coupled to a wireless transceiver 34, a clock circuit 36, and a sounder 38 to emit an audible alarm or a non-alarm audible output. The detector 18-1 can be powered via a battery 40**.

It will be understood that a variety of detector based, non-emergency indicating conditions, such as low battery, increasing non-smoke output levels, or gas sensor end of life indications, can be signaled audibly using the sounder 38. Time intervals can be established for the generation of corresponding audio outputs to warn users in the vicinity that maintenance is needed for a detector, such as 18-1, via the system 10. In another embodiment, the keypad 14 can communicate directly with the detectors 18.

Figure 2:
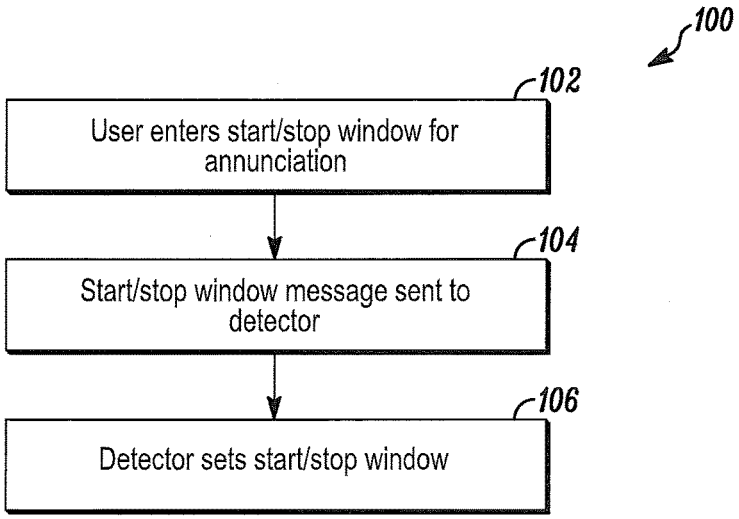
FIG. 2 is a flow diagram of a process for setting a start/stop window.
Figure 3:
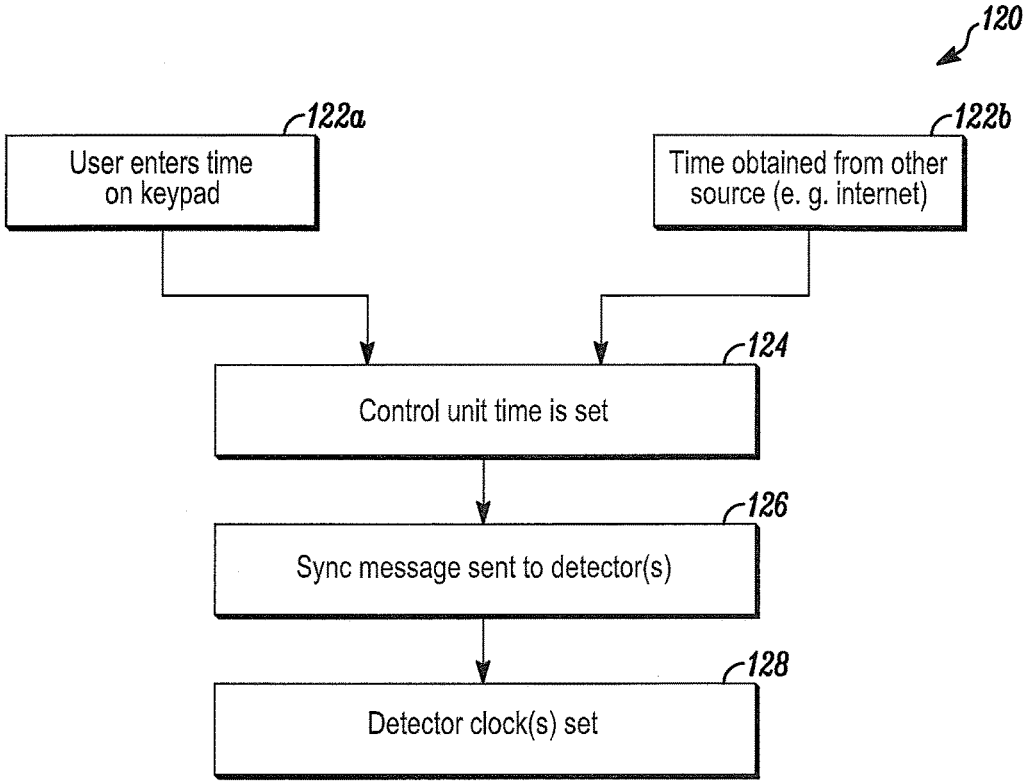
FIG. 3 is a flow diagram of a process for setting a detector clock.
Figure 4:
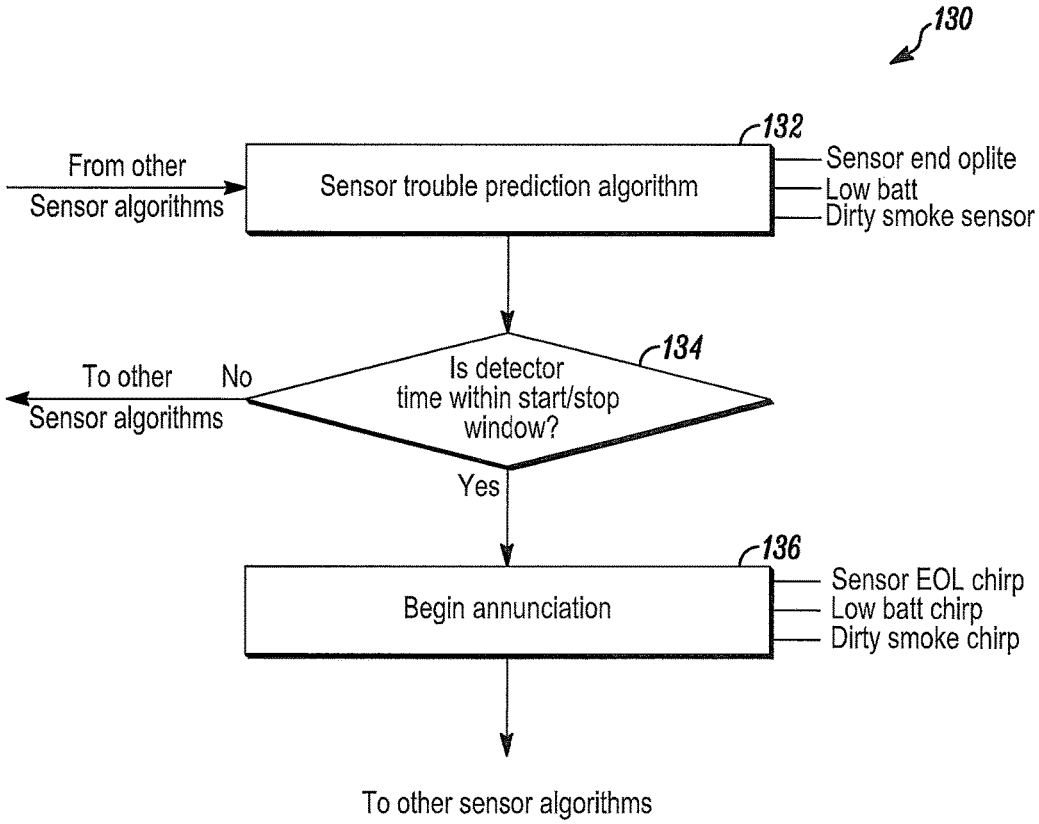
FIG. 4 is a flow diagram of additional processing in accordance herewith.

FIGS. 2-4 illustrate aspects of a process of adjusting detector annunciation times and time intervals. FIG. 2 illustrates aspects of a process 100 for setting a start/stop window. A user enters information as to a start/stop window for annunciation, as at 102. This information can differ between detectors.

A window defining message is sent to a selected detector, such as 18-1, as at 104. The selected detector stores information, for example, in the storage circuits **32*b*, related to the window, as at 106**.

FIG. 3 illustrates aspects of a process 120 for setting a real-time clock, such as 36, for a selected detector such as 18-1. Either a user enters current time information on a keypad, such as the keypad 14, as at **122*a*, or current time information is obtained automatically from another source, as at 122*b***.

The control unit 12 sets the entered time on its clock, such as the clock 20, as at 124. A synch message is sent to one or more of the detectors 18, as at 126. The selected detector(s) sets its respective clock, such as the clock 36, as at 128, in response to the synch message 126.

FIG. 4 illustrates processing 130 by a detector, such as the detector 18-1. A trouble prediction process or algorithm is executed at a selected one of the detectors 18 to determine which, if any, non-emergency message should be issued, as at 132.

A detector based determination is then made to establish whether detector time, as on the clock 36, is within the start/stop window previously stored in the circuits **32*b*. If so, then the appropriate output message is annunciated, as at 136, by the sounder or the annunciator 38. The non-emergency trouble indicator can be emitted for a fixed period of time or until the time indicated by the clock 36** exceeds the end of the pre-set window.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

a detector that includes an ambient condition sensor, control circuits coupled to the ambient condition sensor, an output device, and a clock circuit coupled to the control circuits and configured to indicate a current time, wherein the control circuits make a detector-based determination to activate the output device responsive to a predetermined, non-alarm detector condition when the current time is within an activation window, wherein the control circuits prevent activation of the output device when the current time is outside of the activation window, wherein the activation window defines a start time of day and a stop time of the day, and wherein the predetermined, non-alarm detector condition includes a detector dirty signal or an end of life notice.

2. The apparatus as in claim 1 further comprising a manually operable element separate from the detector to provide the start time of the day and the stop time of the day for the activation window to activate the output device in response to the predetermined, non-alarm detector condition.

3. The apparatus as in claim 2 further comprising synchronization circuits that, responsive to a synchronization message, set the clock circuit to a predetermined time.

4. The apparatus as in claim 2 wherein the output device is selected from a class that includes an audible output device or a visual output device.

5. The apparatus as in claim 2 wherein at least one of the start time of the day or the stop time of the day is obtained from the manually operable element.

6. The apparatus as in claim 3 wherein the control circuits respond to a received wireless synchronization signal to set a time parameter in the clock circuit.

7. The apparatus as in claim 5 further comprising a control unit wirelessly coupled to the detector, wherein the control unit responds to input signals from the manually operable element providing the start time of the day and the stop time of the day for the activation window to activate the output device.

8. The apparatus as in claim 7 wherein the control unit emits a synchronization signal to establish a time parameter at the detector.

9. The apparatus as in claim 7 wherein a plurality of detectors wirelessly communicate with the control unit.

10. The apparatus as in claim 1 wherein the detector activates the output device to identify the predetermined, non-alarm condition at a preset time within the activation window.

11. The apparatus as in claim 10 wherein the activation of the output device continues for a predetermined time interval.

12. The apparatus as in claim 11 wherein first and second different conditions are identified starting at respective ones of first and second different times or windows.

13. The apparatus as in claim 12 further comprising a plurality of detectors in communication with a control unit, wherein at least one of the plurality of detectors identifies the predetermined, non-alarm detector condition at different predetermined times.

14. The apparatus as in claim 13 wherein the at least one of the plurality of detectors includes a first type of the ambient condition sensor.

15. An apparatus comprising:

a detector that includes an ambient condition sensor, control circuits coupled to the ambient condition sensor, storage circuits coupled to the control circuits, and a clock circuit coupled to the control circuits configured to indicate a current time; and a manually operable element to provide an activation window, wherein the control circuits make a detector-based determination to activate an output device responsive to a predetermined, non-alarm detector condition when the current time is within the activation window, wherein the control circuits prevent activation of the output device when the current time is outside of the activation window, wherein the activation window defines a start time of day and a stop time of the day, and wherein the predetermined, non-alarm detector condition includes a detector dirty signal or an end of life notice.

16. The apparatus as in claim 15 further comprising a plurality of detectors, wherein at least one of the plurality of detectors responds to smoke or fire and at least one other of the plurality of detectors responds to a selected gas, and wherein each of the plurality of detectors includes a wired or wireless communication interface.

17. The apparatus as in claim 16 wherein at least one of the start time of the day or the stop time of the day is stored in the storage circuits.

18. The apparatus as in claim 15 wherein the detector includes a clock, and wherein the control circuits respond to a received wireless synchronization signal to set a time parameter in the clock.

19. A method comprising:

a detector setting clock circuitry based on time data received from a control unit;

the detector receiving a window defining message from the control unit indicating a time window when the detector may activate an output device, wherein the time window defines a start time of day and a stop time of the day;

the detector activating the output device in response to a non-emergency message when the time data from the clock circuitry indicates that a current time is within the time window; and the detector preventing activation of the output device in response to the non-emergency message when the time data from the clock circuitry indicates that the current time is outside of the time window, wherein the non-emergency message includes a detector dirty signal or an end of life notice.

* * * * *